United States Patent [19]

McNeill

[11] 4,418,463

[45] Dec. 6, 1983

[54] METHOD OF FABRICATING A COMPOSITE STRUCTURE OF CONCRETE AND STEEL METWORK

[75] Inventor: Robert C. McNeill, Ogden, Utah

[73] Assignee: Ogden Structural Products, Inc., Ogden, Utah

[21] Appl. No.: 228,581

[22] Filed: Jan. 26, 1981

Related U.S. Application Data

[63] Continuation-in-part of Ser. No. 151,428, May 19, 1980, abandoned.

[51] Int. Cl.[3] ..... B22D 11/126; B21F 15/08; B21F 27/10

[52] U.S. Cl. ..... 29/527.4; 428/446; 140/112; 219/56

[58] Field of Search ..... 428/446; 140/112; 219/52, 56, 58; 29/527.4, 527.6, 527.7

[56] References Cited

U.S. PATENT DOCUMENTS

| | | | |
|---|---|---|---|
| 980,602 | 1/1911 | Clark | 219/56 X |
| 3,164,891 | 1/1965 | Gier, Jr. | 219/58 |
| 3,298,402 | 1/1967 | Hale | 140/112 X |
| 3,305,991 | 2/1967 | Weismann | 140/112 |
| 3,347,007 | 10/1967 | Hale | 52/378 |
| 3,396,761 | 8/1968 | Laswell | 140/112 |
| 3,407,560 | 10/1968 | Baumann | 52/383 |
| 3,413,512 | 11/1968 | Buck | 140/112 |
| 3,559,355 | 2/1971 | Day, Jr. | 52/383 |
| 4,104,842 | 8/1978 | Rockstead et al. | 52/309.12 |
| 4,236,364 | 12/1980 | Larson et al. | 52/383 |

*Primary Examiner*—Howard N. Goldberg
*Assistant Examiner*—V. K. Rising
*Attorney, Agent, or Firm*—A. Ray Osburn

[57] ABSTRACT

A method of fabricating a composite structure comprising wire mesh and concrete. The longitudinal wires of a section of such wire mesh are formed together into a repeating sinuous pattern perpendicular to the transverse wires, so that the alternate transverse wires together comprise two groups each in one of two parallel spaced apart planes. A flat section of similar mesh is placed against each of these groups. Each of the flat sections of mesh and the juxtaposed group of transverse wires of the formed mesh are in turn placed together to be cured, into first and second layers of wet concrete mixes in suitable forms to produce the composite concrete-steel network structure. The relatively light weight structure may be utilized for floor, ceiling or roof slabs, and for column load bearing wall panels. According to other aspects of the invention, the mesh sections and the concrete layers may also be curved transversely or longitudinally, so as to comprise composite arcuate panels for tanks or other curved structures. The space between the concrete layers may carry circulation barriers or insulation material to increase the insulating properties of the structure.

2 Claims, 13 Drawing Figures

METHOD OF FABRICATING A COMPOSITE STRUCTURE OF CONCRETE AND STEEL METWORK

RELATED APPLICATIONS

This application is a continuation-in-part application based on co-pending application Ser. No. 151,428 now abandoned; filed May 19, 1980; Art Unit 164; Van Belen, Examiner; for "Composite Structure of Concrete and Steel Network."

BACKGROUND OF THE INVENTION

1. Field

The field of the invention is rigid composite steel-concrete structures and more particularly such structures comprising network reinforcement.

2. State of the Art

Many beams, slabs, columns and other structures are commonly made up of concrete with steel reinforcing members embedded in the concrete in proper locations to resist flexural and column buckling stresses. Most commonly, individual steel bars are used, and the concrete is monolithic within such structures. Floor slabs, for instance, generally comprise a single layer of concrete with embedded tensile and compressive reinforcing bars near its bottom and top surfaces respectively. Sometimes, flat sections of steel network are used in such structures. Occasionally, three dimensional reticulated reinforcing structures have been used so as to each provide both tensile and compressive reinforcement. An example of such a reinforcing structure is disclosed in U.S. Pat. No. 3,825,465. U.S. Pat. Nos. 993,851, and 1,578,416, disclose reticulated structural members, not however adapted for use in concrete structures. A form of three dimensional network structure known as steel studding is sometimes used as a core structure for supporting attached plasterboard, or plaster or stucco applied thereon. Such core structures do themselves resist column type loads, but do so essentially unaided by the plaster or the like.

The above mentioned uses of network reinforcement, whether two or three dimensional, in monolithic beams, slabs and the like, have been wasteful of concrete, since the concrete near the flexural axes is very inefficiently utilized. The structures have accordingly been unnecessarily heavy. Further, such structures have not exhibited maximum capacity as insulating structures.

BRIEF SUMMARY OF THE INVENTION

The present invention eliminates or significantly alleviates the aforesaid disadvantages in present reinforced concrete structures by providing a structure comprising a pair of layers of concrete spaced apart and tied together by a three dimensional central steel network and further reinforced by a two dimensional steel network embedded in each. The central network member is preferably fabricated of a section of available wire mesh having perpendicular wires, by forming its longitudinal wires together into a repeating sinuous pattern. The longitudinal wires are bent together in equal angular amounts, but in alternately reversed direction, at each of the transverse wires of the mesh. Alternate ones of the transverse wires then form two sets of wires, one in each of two spaced apart parallel planes. A generally flat member of similar wire mesh is juxtaposed generally against each one of the sets, with its transverse wires generally parallel to those of the central member.

The two concrete layers each encase one of the flat steel network members along with the adjacent set of straight transverse wires of the three dimensional central member. According to one aspect of the invention, the composite structure may be pre-stressed, in which case pre-tensioned longitudinal cables are used in lieu of one of the flat network members, or in addition thereto.

The composite structure is generally fabricated as an elongate rectangular structural panel for use as a floor or roof slab, or for an upstanding section of a wall. The spaced apart concrete layers are structurally integrated by the sinuous longitudinal wires of the central structure, so that the composite structure efficiently resists both flexural and buckling loads. For such uses, the structure may further comprise an elongate reinforced concrete member between one or both of the pairs of edge portions of the concrete layers, such members serving as beams for slab use of the panel and as columns for wall use of the panel. For slab use, the members may be pre-stressed. According to another aspect of the invention, such as panel may comprise the web of a beam, the sinuous longitudinal wires then being directed transverse to the larger dimension of the panel, and the wires of the flat networks angularly thereto to efficiently resist web buckling. Such a panel may be adapted to carry an elongate reinforced concrete member between each of the pairs of the edge portions of the concrete layers of the panel, one being the beam tension member and the other the beam compression member, the tension one of which may be pre-stressed. For use in curved structures, such as the walls of tanks, the steel networks and concrete layers may be further formed so that the composite panel is arcuate.

It is a principal object of the invention to provide a method of fabricating an economical type of rigid composite concrete-steel load-bearing structure efficiently utilizing concrete and network steel reinforcement, said structure being adaptable for use in roofs, floors, and walls, as both cast-in-place and prefabricated building units.

BRIEF DESCRIPTION OF THE DRAWINGS

In the accompanying drawings, which represent the best mode presently contemplated for carrying out the invention.

DETAILED DESCRIPTION OF ILLUSTRATED EMBODIMENTS

Figure 1:
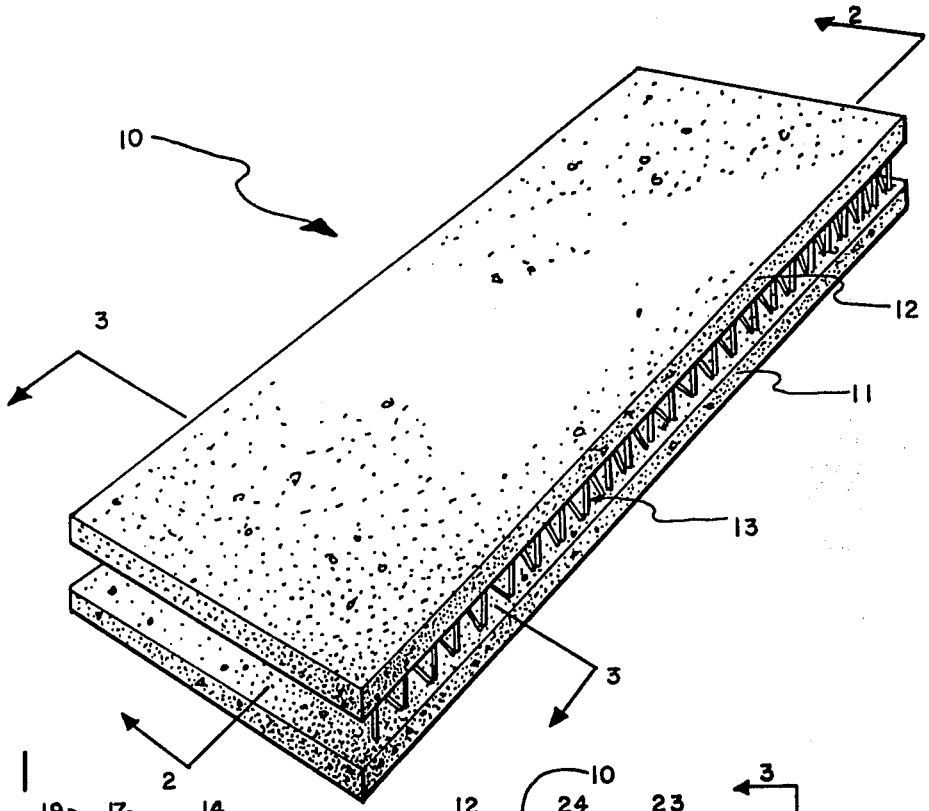
FIG. 1 is a perspective representation of a building panel in accordance with the invention.
Figure 2:
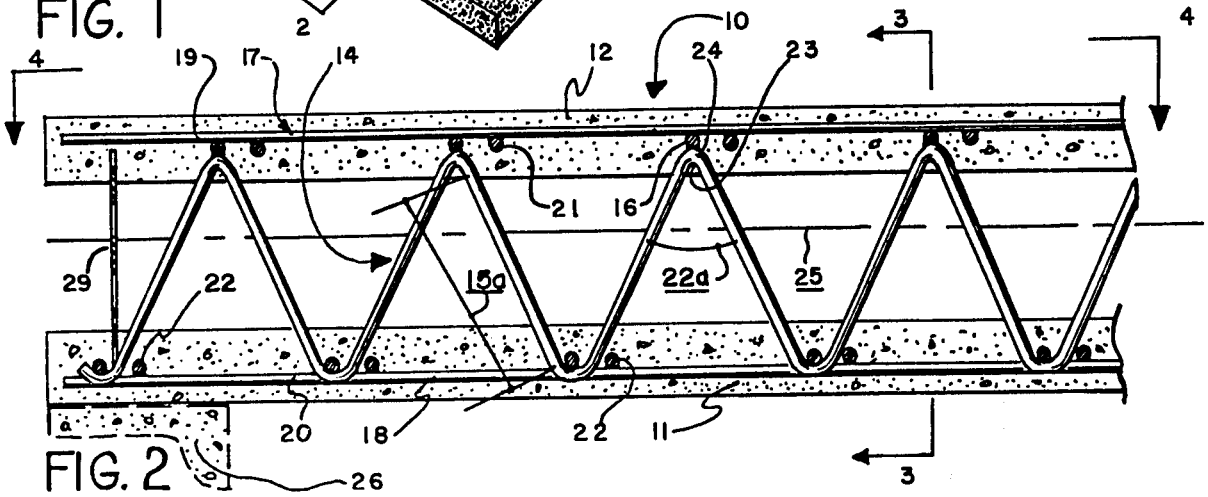
FIG. 2 is a fragmentary sectional view taken along line 2—2 of FIG. 1, drawn to a somewhat larger scale.
Figure 3:
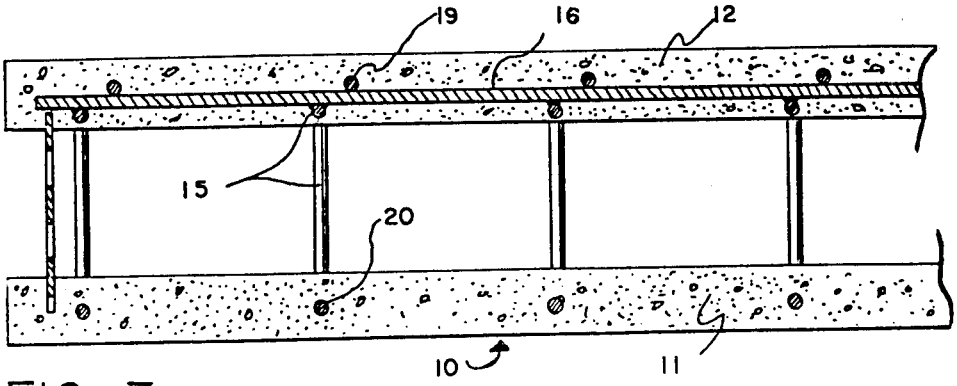
FIG. 3 is a fragmentary sectional view taken along line 3—3 of FIG. 1, drawn to the scale of FIG. 2.
Figure 4:
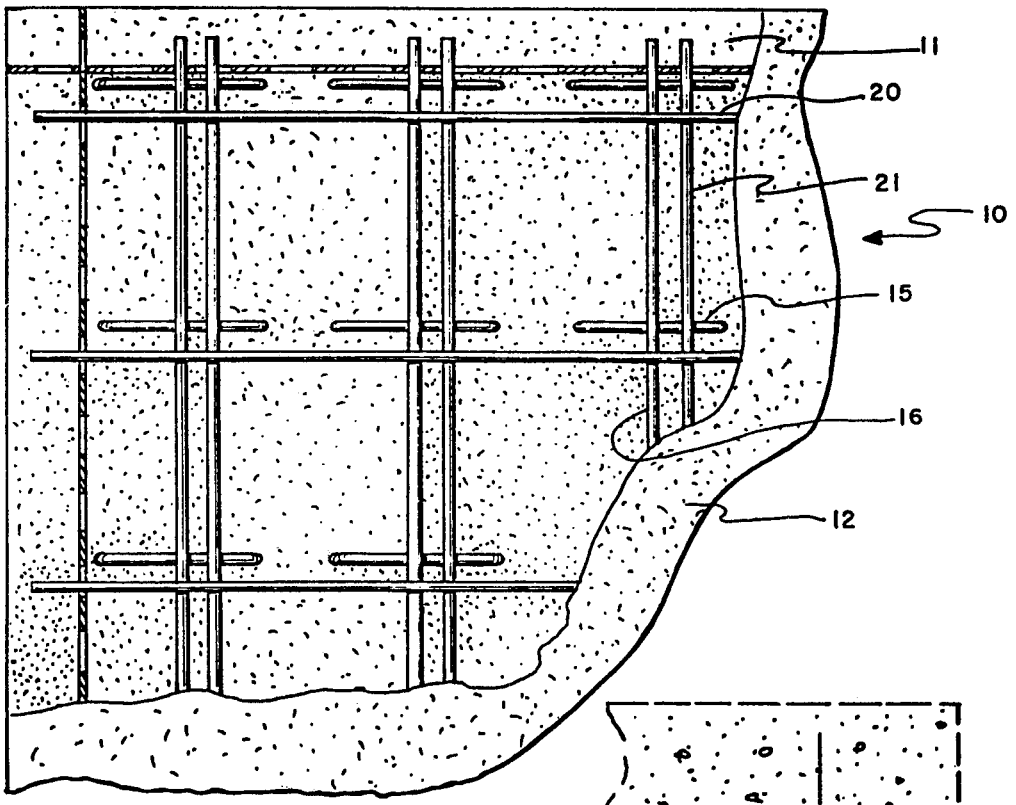
FIG. 4 is a fragmentary top view of the panel of FIG. 1, partially cut away and drawn to the scale of FIG. 2.

A structural building panel, generally 10, illustrative of the invention, is seen in FIG. 1, comprising lower and upper concrete layers 11 and 12 respectively, and a partially seen, wire network structure generally 13, connecting said layers. In FIG. 2, network structure 13 is seen to comprise a three dimensional central structure, generally 14, having sinuous longitudinal wires 15 and straight lateral wires 16 welded thereto. Two dimensional network members 17 and 18 are placed generally against upper and lower transverse wires 16 of central network 14 respectively, and comprise longitudinal and transverse wires 19 and 21 and 20 and 22 respectively. Networks 17 and 18 are encased in concrete layers 12 and 11 respectively, as are alternate ones of the lateral wires 16 of central member 14. (FIGS. 3 and 4)

Figure 8:
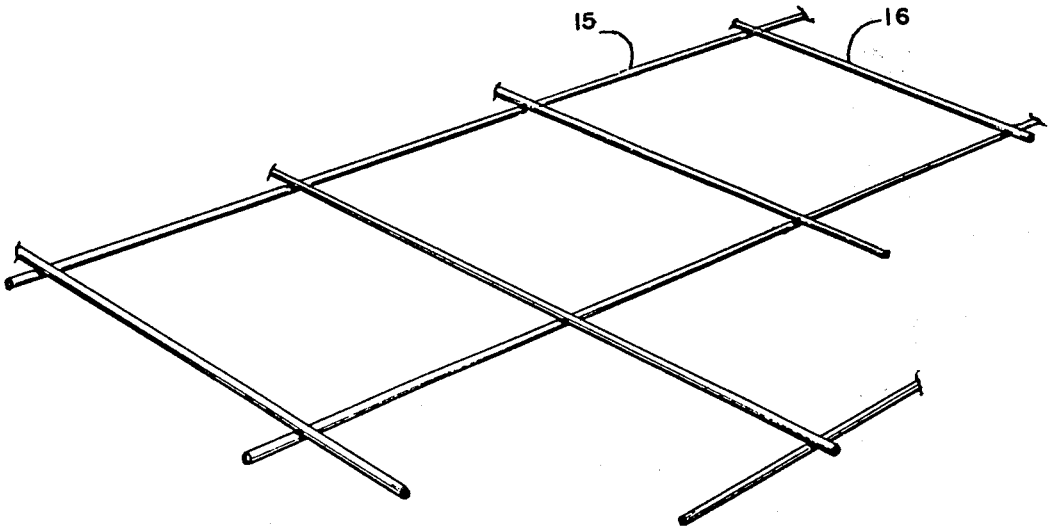
FIG. 8 is a fragmentary perspective view of prefabricated wire mesh, drawn to the scale of FIG. 2.

Central member 14 may be readily formed from a section of flat mesh (FIG. 8). Such flat mesh is readily available in selectable wire sizes and spacing to meet the requirements of the particular structure 10. Openings may be square as illustrated, or rectangular. The wires 15 and 16 are electrically resistance welded together. Networks 17 and 18 may also be selected from such available wire mesh. Longitudinal wires 15 are bent together successively through equal angles 22*a* at each lateral wire 16. Preferably, each section 15*a* of wire 15 between successive ones of transverse wires 16 is straight and as long as possible, bend radii 23 being made as small as practical. Each straight section 15*a* acts within structure 10 as a column under compressive stress holding concrete layers 11 and 12 in spaced apart relationship, and the ends of each such column is anchored into said layers through cross wires 16. Preferably, bends 24 are also embedded to further fix the column ends against rotation, for increased buckling strength.

Structural panel 10 may be used as a floor or roof slab, or as an upstanding load-bearing wall panel. It is efficient for all such uses, the concrete all being concentrated a substantial distance from neutral plane 25, located between layers 11 and 12 of the composite structure 10. When structure 10 is used as a floor or ceiling slab simply supported upon foundation or walls 26 (FIG. 2), concrete layers 11 and 12, with embedded network members 17 and 18, provide compressive and tensile wires 19 and 20 respectively, each well removed from neutral plane 25, to resist bending from its weight and superimposed loads. It is well known that the concrete near the neutral axes or planes of monolithic concrete beam structures is largely inoperative, serving only to resist shear. In structure 10, the straight column segments 15*a* of longitudinal wires 15 resist horizontal and vertical shear, and maintain the compressive and tensile layers 11 and 12 in proper spaced apart relationship, so that such inoperative concrete is omitted from the structure.

Figure 6:
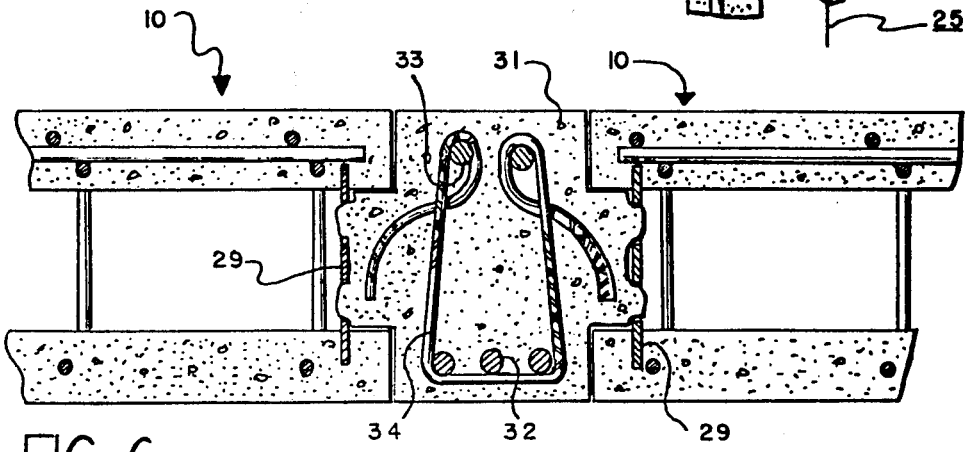
FIG. 6 is a fragmentary sectional view of a floor of the panels of FIG. 1, drawn to the scale of FIG. 2.
Figure 10:
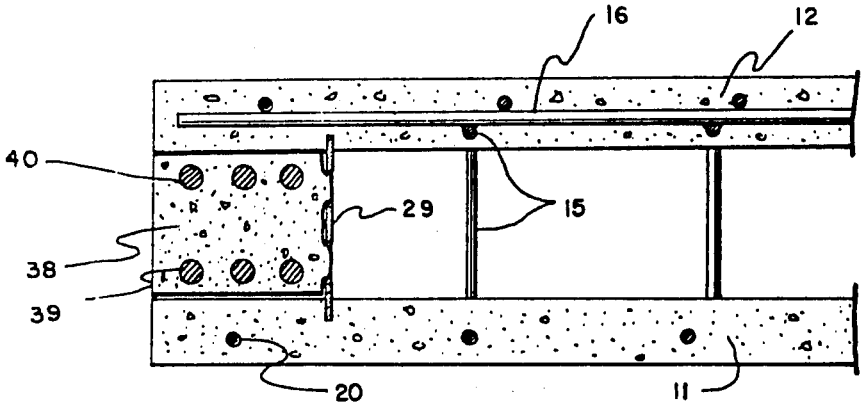
FIG. 10 is a fragmentary sectional view of the panel of FIG. 1 having also a strengthening beam member.
Figure 11:
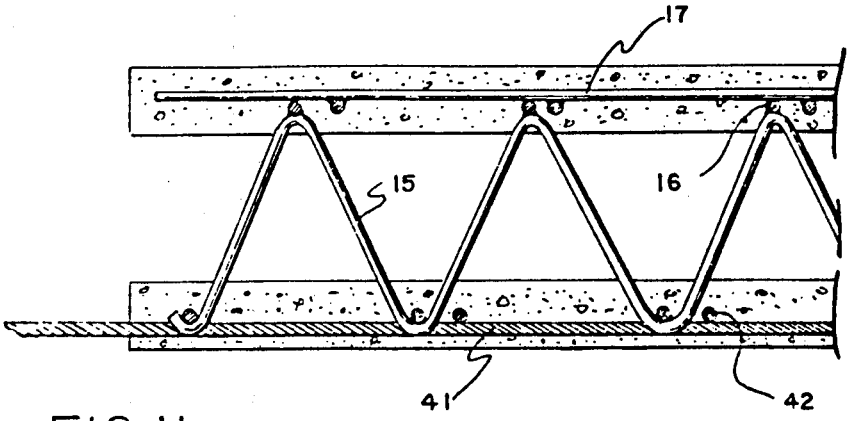
FIG. 11 is a fragmentary sectional view of a prestressed version of the panel of FIG. 1.

A large selection of connecting, flexure resisting structures may be used to tie adjacent structures 10 together into floor or roof structures. In FIG. 6, connecting beam 31 provides uninterrupted floor and ceiling surfaces continuous with the surfaces of the concrete layers 11 and 12. Tensile reinforcement 32, compressive reinforcement 33, and shear reinforcement 34 may be provided in the amount and configuration required. Connecting beam 31 helps to support the floor or roof loads, so that structure 10 may be constructed with less concrete and/or steel reinforcement. Conversely, structure 10 may be designed to support such loads alone, in which case beam 31 is not structurally required. The structure 10 may then be disposed in direct contact together to form the floor or roof. When strengthening is required, the designer may prefer to pre-fabricate structure 10 in strengthened form by precasting a reinforced member 38 between concrete layers 11 and 12 at one or both of its longitudinal edges. (FIG. 10) Such strengthened structures 10 may also be advantageously used for upstanding wall panels, with members 38 serving as columns which may be required by the building structure. Reinforcement 39 and 40 may be provided so that member 38 may serve as either beam or column, as required by the particular application.

Where structural panels 10 are to be used as long span floor or roof slabs, it is advantageous to employ the techniques of pre-stressing. For such long span beam type applications, the longitudinal wires 20 may advantageously be prestressed, to increase the load carrying capacity of structure 10. To accomplish this, wires 20 of network member 18 may be pretensioned when concrete layer 11 is cast and cured therearound. However, it is preferable that a more conventional type of prestress reinforcement be used instead of member 18. (FIG. 11) Concrete layer 11 is cast and cured about tensioned longitudinal steel cables 41, along with the transverse wires 16 of central network member 14. Transverse wires 42, untensioned and unattached to cables 41, may be included to bind layer 11 transversely, or network structure 18 may be used in its entirety. The end portions of tensioned cables 41 shown extending beyond the ends of layer 11 are severed after a period or cure of the concrete in layer 11. It may also be advantageous that member 38 be pre-stressed, the reinforcement 39 in that event comprising pretensioned cables.

Figure 5:
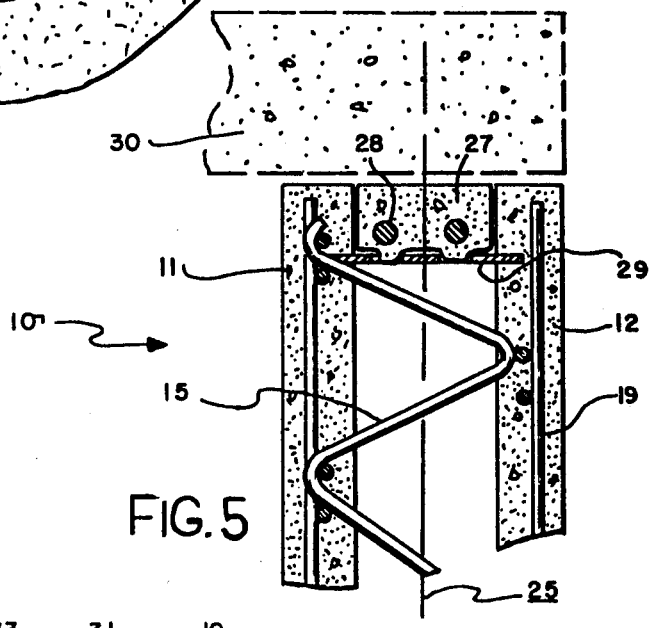
FIG. 5 is a fragmentary sectional view of the panel of FIG. 1 utilized as a wall panel, drawn to the scale of FIG. 2.

When composite structure 10 is utilized as a section of an upstanding wall itself supporting a floor or roof 30 (FIG. 5), it functions as a column. A concrete member 27, carrying reinforcing bars 28, may be used to close the space between layers 11 and 12 at the top and bottom of structure 10, and may be continuous between successive aligned wall panel structures 10 to tie the wall together. A barrier 29, of expanded metal, wood or the like, facilitates the casting of member 27. Again, it is efficient to utilize the concrete of the composite structure 10 distantly from the neutral plane 25, to provide needed buckling resistance while using minimum concrete, with columns 15*a* integrating layers 11 and 12 in a unified composite structure 10.

Figure 7:
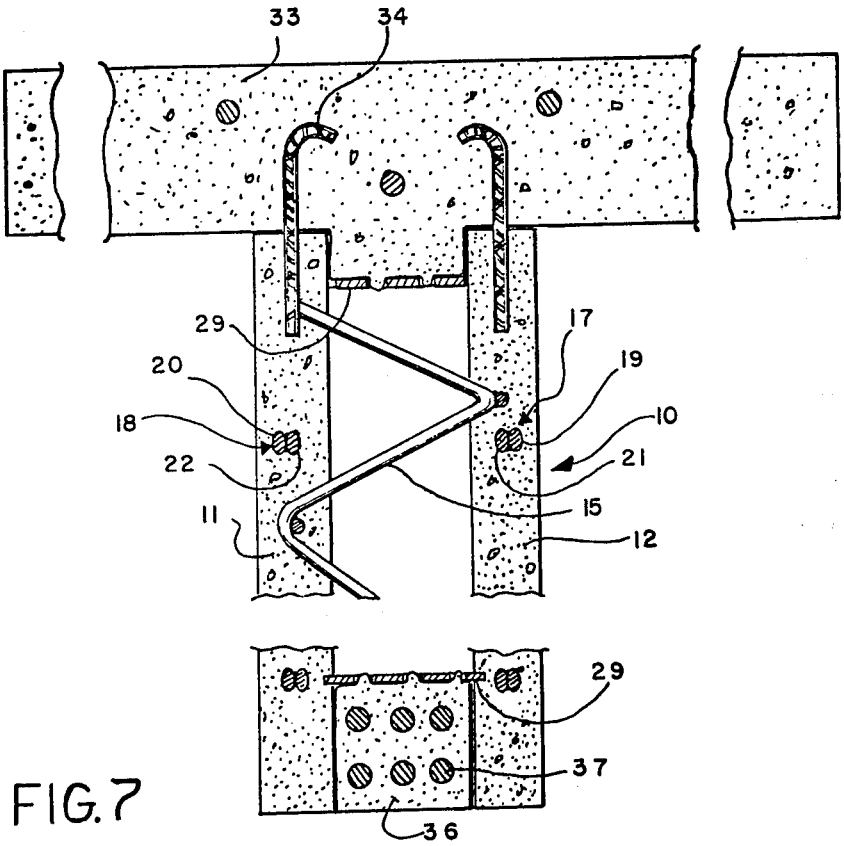
FIG. 7 is a fragmented sectional view of the panel of FIG. 1 used as the web of a tee beam, drawn to the scale of FIG. 2.

Structural panel 10 may also be utilized as the web of a composite concrete-steel tee beam. (FIG. 7) For this application it is desirable that the longitudinal wires 15 be installed transverse to the structural unit 10. The concrete layers 11 and 12 in this application are in combined shear and compression, each subjected to web buckling stresses. The transversely oriented wires 15 stabilize layers 12 and 11 to act as a single structural unit to resist the web buckling. It is also desirable that the meshes 17 and 18 both be oriented with their wires directed at approximately 45 degrees to structure 10, to resist the horizontal and vertical shear stresses in each layer 11 and 12. Structure 10 is tied to compression flange 33 of the composite beam through shear ties 34 cast into each of the layers 12 and 11. Tensile capability is provided in the composite beam by tension member 36 with tensile reinforcing bars 37. Compression flange 33 is illustrated in FIG. 7 as being a portion of a floor slab. However, such a compression member may be pre-cast between two of the edge portions of layers 11 and 12, similarly to tension member 36, to produce a complete pre-fabricated beam structure with structure 10 as the web.

Figure 9:
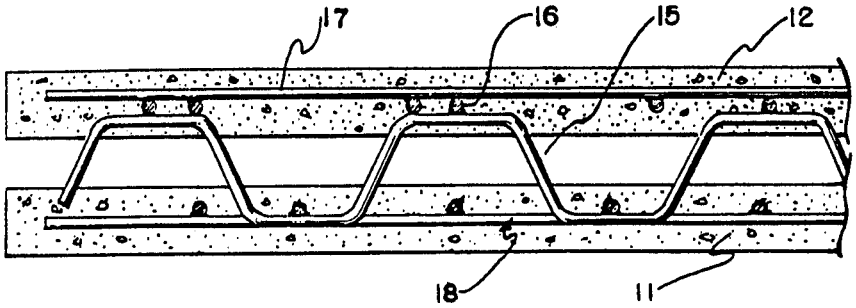
FIG. 9 is a fragmentary sectional view of a panel of reduced thickness, drawn to the scale of FIG. 2.

While structure 10 is illustrated and described as preferably comprising three and two dimensional network structures of available pre-fabricated mesh, they may of course be built up of individual wires without departing from the spirit of the invention. Pre-fabricated wire meshes for central structures 14 and networks 17 and 18 may each be selected for the particular application. Meshes of larger or smaller wire may be selected, with square or rectangular wire patterns, for use within any particular structure 10. Selected network structures need not be uniform throughout structure 10. For floor slab and wall panel applications, for example, the designer may prefer to select heavier mesh 14 for use near the centers of the structures 10 to withstand the locally higher flexural or buckling stresses. Or, supplementary mesh sections may be added at such locations. Bend angle 22*a* of longitudinal wires 15 may be selected within wide limits when thicker or thinner structures 10 are desired. Or, thinner structures 10 may be achieved by bending the longitudinal wires 15 at locations somewhat removed from the transverse wires 16 (FIG. 9). The concrete selected for layers 11 and 12 may similarly be selected for the most advantageous functioning under the particular application. In general, conventional structural concrete is preferred, using sand and gravel aggregate ("structural concrete" herein implying significant strength, especially compressive). However, light weight, more insulative structural concrete may sometimes be preferable, comprising light weight aggregates such as pumice, scoria, expanded shale or the like. Also, cardboard or plastic barriers or the like may be inserted in the spaces between layers 11 and 12 to decrease internal circulation, or insulating material may be used to fill such spaces. Panel structures 10 may be fabricated as rectangular, square, and circular, for example, or even with a tapering thickness. It may be generally flat, or curved to form sections of wall or a circular tank structure, for example.

Figure 12:
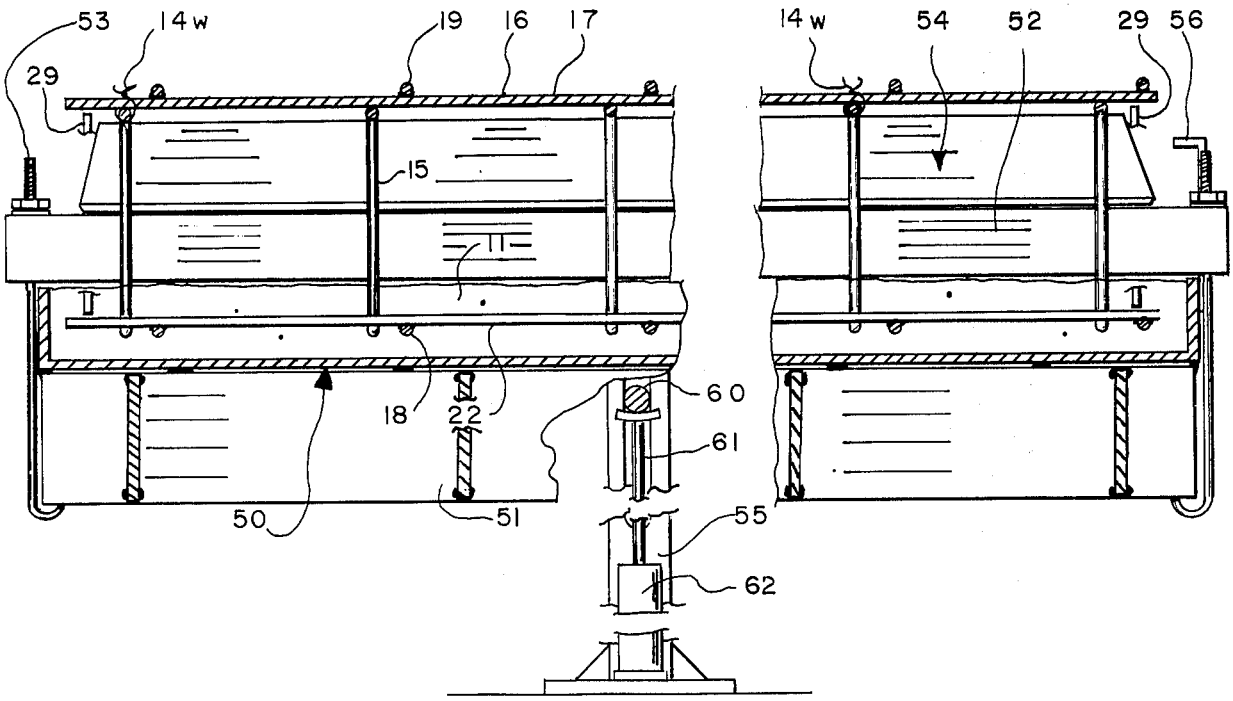
FIG. 12 is a fragmentary transverse sectional view of the panel taken during an intermediate step in its construction.

To fabricate structure 10, a shallow rectangular form 50, for example, is supported in horizontal position, as in FIG. 12, and filled with a wet mix of structural concrete to form layer 11. Network structure 13 is then positioned and supported within form 50 so that two dimensional member 18, the lower set of transverse wires 16 and the lower bent portions of longitudinal wires 15 are all embedded in mixture 11, at elevations to provide the selected top and bottom cover. The two dimensional members 17 and 18 may be advantageously secured at sufficient distributed points to central structure 14 as by tie wires 14*w*, so that the network structure 13 may be conveniently handled as a unit. When desired in structure 10, the barriers 29 are conveniently tied to one or more of the wire structures.

For ease in handling and prevention of damage to structure 10 during fabrication, it is advantageous to secure form 50 to a stiffening pallet 51 as by welding. A number of clamping members 52 are inserted at intervals through network member 13, and clamped against the rim of form 50 and to pallet 51 by J-bolts 53. Network structure 13 may then be vertically positioned as required by inserting support angle members 54 to rest conveniently upon the tops of the clamping members 52 so as to engage wires 15 at their bends. If necessary, structure 13 may be weighted or otherwise held firmly downward against supports 54. Preferably, pallet 51 is mounted centrally at each end through one of two pivot pins 60 to one of two pallet supports 55. After initial cure of mixture 11, pallet 51 may be easily rotated about pins 60 along with form 50 into the reversed horizontal position shown in FIG. 13, with the partially fabricated structure 10 now supported through layer 11 by clamping members 52. Supports 54 are removed. Stresses in layer 11 are substantially alleviated by the use of sufficient clamping members 52. Otherwise complete cure of layer 11 would be necessary.

Figure 13:
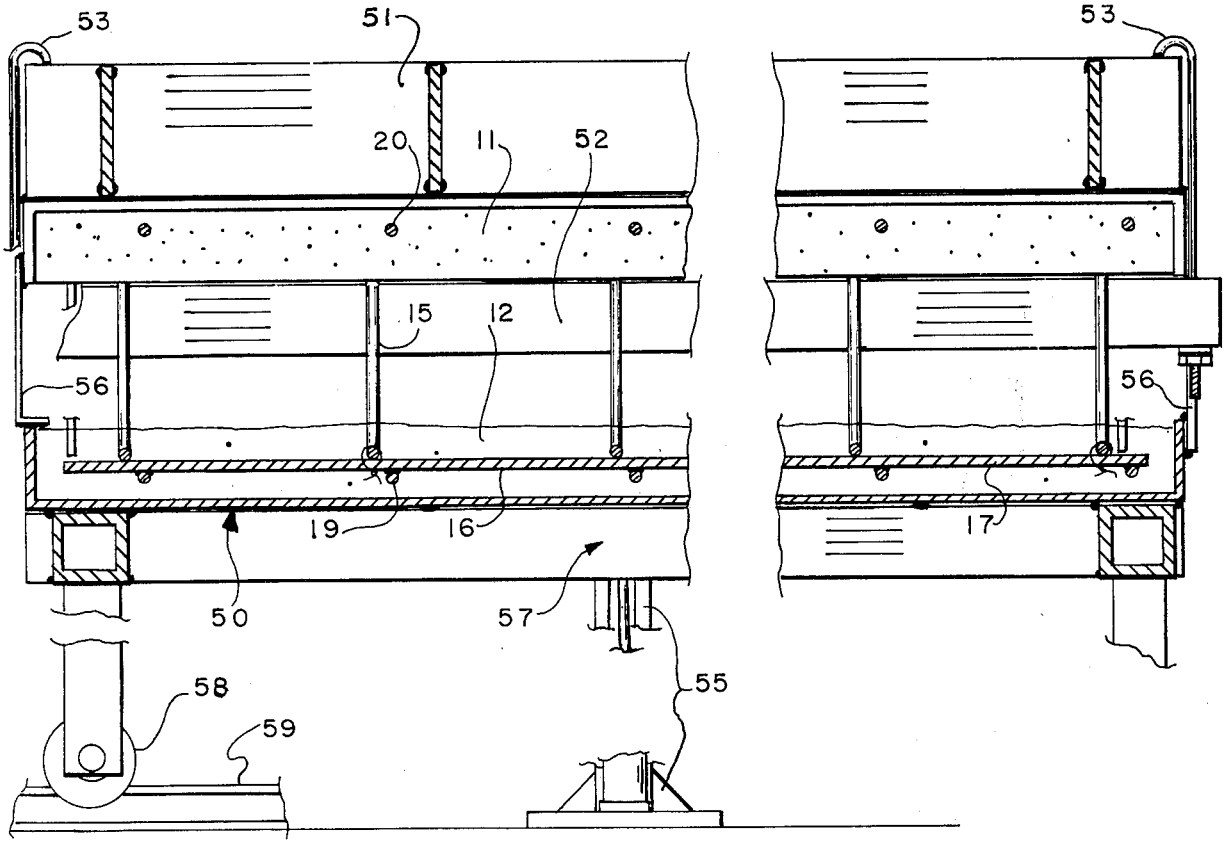
FIG. 13 is a fragmentary transverse sectional view of the panel taken during another intermediate step in its construction.

A second form 50, is then filled with a layer 12 of uncured concrete and is positioned so that pallet 51 may be lowered to position structure 13 as seen in FIG. 13. Planar member 17, the other set of transverse wires 26 and the remaining set of bent portions of longitudinal wires 15 are all embedded in proper location in concrete mixture 12. For support of pallet 15 in proper vertical position, one or both forms 50 may carry a number of vertically standing spacing members 56. It is desirable for the supporting pivots 60 to be supported in vertical guiding slots 61 in pallet supports 55, so that manual jacks 62, for example, may be used to facilitate the raising and lowering of pallet 51. It is also convenient for the second form 50 to be secured to a table 57 with wheels 58 engaging tracks 59, so that it may be easily rolled into position after mixture 12 is placed and smoothed.

After layer 12 has cured sufficiently, completed structure 10 may be removed from the forms 50. It is convenient to remove J-bolts 53, releasing clamping members 52, and then to raise pallet 51, as by jacks 62, withdrawing the first form 50 from about layer 11, and table 57, carrying structure 10 is then rolled clear of pallet 51. The completed structure 10 may then be drawn upwardly out of the second form 50, by any suitable lifting equipment such as an overhead crane or the like.

Many of the details of the method of fabrication of structure 10 described herein are highly advantageous, but are for illustrative purposes only and may be varied considerably without departing from the spirit of the inventive method. For example, form 50 could be removed from layer 11 after its partial or complete cure, so that form 50 could be re-used, the second form 50 then not being required. Form 50 and pallet 51 could be integrally constructed instead of being separate structures secured together as described. The pivot mounting is very advantageous, but the structure could be turned over using other arrangements and equipment. Neither of the layers 11 and 12 need necessarily fill the forms 50, since clamping members 52 may be shaped to accommodate layers of reduced thickness.

The embodiments and methods illustrated and described herein are for illustrative purposes only, and are not intended to be restrictive. The length and breadth of the invention are defined by the appended claims. All embodiments included within the boundaries of the claims and all equivalents thereof are intended to be embraced therein.

I claim:

1. The method of fabricating a composite structure of concrete and steel network, comprising the steps:

providing a three dimensional wire network structure;

providing a first upwardly opening form, said form including members to provide a stiff structural assembly, and means pivotally supporting the assembly about a longitudinal axis thereof, so that the assembly may be rotated about said axis;

providing a first layer of high structural strength concrete mix the length and breadth of the first upwardly opening form;

lowering the network structure into the mix in the form so that a portion of one side of said structure is submerged within the mix;

providing means supporting the three dimensional structure upwardly from the bottom of the form, so that the wires thereof are above the bottom of the first form;

providing means for clamping the first layer into the form upon the subsequent cure of said layer;

allowing a period of time for the first concrete layer to cure at least to initial hardness;

providing a second upwardly opening form with a second layer of high structural strength concrete mix the length and breadth thereof;

pivoting the stiffening structure over and supporting said structure so that a portion of the other side of the wire structure is submerged within the second concrete layer parallel to and above the bottom of the second form; and allowing a period of time for the second concrete layer to cure at least to initial hardness.

2. The method of fabricating a composite structure of concrete and steel network, comprising the steps:

providing a central three dimensional steel network member comprising spaced apart longitudinal wires each secured to transverse wires equally spaced apart generally the full length of said longitudinal wires, the longitudinal wires being curved at each transverse wire an equal amount in common normal direction thereto, said direction alternating with successive ones thereof;

providing two planar steel network members each comprising spaced apart longitudinal wires each secured to transverse wires spaced apart generally the full length thereof;

loosely tieing each of the planar members at distributed points to the associated wires of the three dimensional member;

providing a first upwardly opening form, said form including members to provide a stiff structural assembly, and means pivotally supporting the assembly about a longitudinal axis thereof, so that the assembly may be rotated about said axis;

providing a first layer of high structural strength concrete mix the length and breadth of the first upwardly opening form;

positioning the three dimensional network member along with one of the planar members into the form;

providing means for clamping the first layer into the form upon the subsequent cure of said layer;

providing means supporting the three dimensional member upwardly from the form, so that the planar member and one of two sets of transverse wires of the three dimensional member are submerged within the concrete layer parallel to and above the bottom of the first form, each of said sets of transverse wires consisting of alternate ones thereof;

allowing a period of time for the first concrete layer to cure at least to initial hardness;

providing a second upwardly opening form with a second layer of high structural strength concrete mix the length and breadth thereof;

pivoting the stiffening structure over and supporting said structure so that the other one of the planar network members and the other one of the sets of transverse wires of the three dimensional member are submerged within the second concrete layer parallel to and above the bottom of the second form; and allowing a period of time for the second concrete layer to cure at least to initial hardness.

* * * * *

UNITED STATES PATENT AND TRADEMARK OFFICE

CERTIFICATE OF CORRECTION

PATENT NO. : 4,418,463

DATED : December 6, 1983

INVENTOR(S) : Robert C. McNeill

It is certified that error appears in the above-identified patent and that said Letters Patent is hereby corrected as shown below:

In the title on the title sheet, left column, third line, "METWORK" should read "NETWORK".

In the title, column 1, third line, "METWORK" should read "NETWORK".

Signed and Sealed this

*Seventh* Day of *August 1984*

[SEAL]

*Attest:*

GERALD J. MOSSINGHOFF

*Attesting Officer*

*Commissioner of Patents and Trademarks*